United States Patent [19]

Tsukada et al.

[11] 4,373,798

[45] Feb. 15, 1983

[54] DEVELOPING DEVICE WITH SHUTTER BLADE

[75] Inventors: Shusei Tsukada, Yokohama; Yasuhide Kurosaki, Mitaka, both of Japan

[73] Assignee: Canon Kabushiki Kaisha, Tokyo, Japan

[21] Appl. No.: 141,588

[22] Filed: Apr. 18, 1980

[30] Foreign Application Priority Data

Apr. 23, 1979 [JP] Japan ..... 54-50547

[51] Int. Cl.[3] ..... G03G 15/09

[52] U.S. Cl. ..... 355/3 DD; 355/14 D; 118/658

[58] Field of Search ..... 355/3 DD, 14 D, 15; 118/652, 656, 657, 658; 15/256.51, 256.53

[56] References Cited

U.S. PATENT DOCUMENTS

| | | | |
|---|---|---|---|
| 3,575,139 | 4/1971 | Nuzum | 118/658 |
| 3,641,969 | 2/1972 | Hakanson | 118/658 |
| 3,660,863 | 5/1972 | Gebasi | 355/15 |
| 4,102,305 | 7/1978 | Schwarz | 118/658 X |
| 4,133,073 | 1/1979 | Marzoli | 15/256.51 X |
| 4,233,935 | 11/1980 | Vehara et al. | 355/3 DD X |
| 4,237,819 | 12/1980 | Ikegami et al. | 118/657 X |
| 4,265,197 | 5/1981 | Toyono et al. | 355/3 DD X |

FOREIGN PATENT DOCUMENTS

| | | | |
|---|---|---|---|
| 54-6555 | 1/1979 | Japan | 355/3 DD |
| 54-8538 | 1/1979 | Japan | 355/3 DD |
| 55-22767 | 2/1980 | Japan | 118/657 |
| 55-96968 | 7/1980 | Japan | 118/657 |
| 419061 | 9/1974 | U.S.S.R. | 355/3 DD |

*Primary Examiner*—G. Z. Rubinson
*Assistant Examiner*—Keith E. George
*Attorney, Agent, or Firm*—Fitzpatrick, Cella, Harper & Scinto

[57] ABSTRACT

A developing device for developing a latent image held on a latent image holding member by application of a developing agent, onto the latent image, which comprises a developing sleeve disposed in confrontation to the latent image holding member, a developer feeding device to feed the developer onto the surface of the developing sleeve, a regulating device to regulate thickness of a developer layer on the developing sleeve, and a shutter blade which is so provided as to be able to take a contact position with the surface of the developing sleeve and a withdrawal position away from the surface.

21 Claims, 13 Drawing Figures

DEVELOPING DEVICE WITH SHUTTER BLADE

BACKGROUND OF THE INVENTION

1. Field of the Invention

This invention relates generally to a developing device. More particularly, it is concerned with a developing device, in which a uniform thin layer of a single component developer is formed on a developer holding means, and then the thin layer of developer is disposed in confrontation to a latent image holding member to develop the latent image.

2. Description of Prior Arts

There have heretofore been known various types of developing devices, which utilize a single component developing agent.

Of these various types, a toner transfer development has been known to be a unique method. According to this method, a single component developer is applied onto a developer holding means in the form of a uniform thin layer, then this thin developer layer is disposed in confrontation to the surface of an electrostatic latent image with a small space gap therebetween, and the developer is caused to migrate from the developer holding means to the electrostatic latent image surface by the electrostatic force of attraction, thereby developing the latent image (vide: U.S. Pat. No. 3,232,190). According to this method, since the developer is not attracted to a non-image portion where no latent image potential exists and also the developer is not in contact with the non-image portion, a favorable development free from fogging can be effected. Further, since no carrier particles are used, there is no possibility of variations in the mixing ratio of the developer, hence no possibility of deterioration in the property of the carrier particles.

The assignee of the present invention has also filed U.S. Patent Application Ser. Nos. 938,101, 938,494, and 58,434, in which different types of the toner transfer development method are proposed.

According to the former two methods, a single component magnetic developer, a developer holding means made of a non-magnetic material, and a magnetic field generating means are arranged in the order as mentioned, and, after the developer is fed onto the developer holding means, a uniform thin layer of the developer is formed on the developer holding means by the magnetic force generated by the magnetic field generating means and a developer layer thickness regulating member. This thin layer of the developer is disposed in confrontation to the surface of an electrostatic latent image with a small space gap being provided therebetween so as to avoid contact at their surfaces. The development is effected by stretching out the developer at positions facing the image portions due to the electrostatic force of attraction. In this case, too, since the development is done in a state of the developer not being in contact with the non-image portion, a developed image perfectly free from the fogging can be obtained.

The latter development method is as follows. A single component magnetic developer, a developer holding means made of a non-magnetic material, and a magnetic field generating means are arranged in the order as mentioned. After the developer has been fed onto the developer holding means, a uniform thin layer of the developer is formed on the developer holding means by the magnetic force generated by the magnetic field generating means and a developer layer thickness regulating member. This thin layer of the developer is disposed in confrontation to the surface of an electrostatic latent image with a small space gap being provided therebetween so as to avoid contact at their surfaces. The development is effected by applying an alternating bias voltage as the developing bias voltage between the electrostatic latent image surface and the developer holding means, and by further changing the space gap with lapse of time. According to this development method, the developer is applied even to the non-image portion of the electrostatic latent image at the initial stage of the development, whereby a half tone portion of the latent image is developed, and, thereafter, the developer is applied only to the image portion with lapse of time. This latter method is effective in obtaining, in comparison with the former development method, a developed image having good reproducibility in the half tone portion and being perfectly free from the fogging.

Thus, according to the developing method wherein the thin layer of the single component developer (hereinafter called also "toner") is disposed in confrontation to a latent image, there can be attained excellent effects in its developing capability, image reproducibility, life of the developer, and so forth, in comparison with the conventional developing method.

However, even with these developing methods, there are various problems to be mentioned hereinbelow in putting them into practice.

(1) Foreign substances get in between the non-magnetic developer holding means and the developer layer thickness regulating member, and the portion where the foreign substances exist do not allow the toner to pass therethrough, whereby no toner can be fed to this portion and streaky irregularity occurs in the toner layer. Most of these foreign substances are paper dust and thread dust which have intruded from outside. In other cases, such foreign substance might be agglomerated mass of the toner particles. Further, depending upon the quality of the toner, it tends to be fused onto the surface of the magnetic blade as the developer layer thickness regulating member, and to grow bigger with lapse of time to cause an irregular surface on the edge part of the magnetic blade. Although the occurrence of this fusion of the toner is largely governed by the material quality of the toner, when the number of revolutions of the non-magnetic sleeve as the developer holding means increases, the force of the toner to collide against the magnetic blade also increases with the consequence that the toner tends to be readily fused to the blade surface. While intrusion of such foreign substances and occurrence of the agglomerated toner due to its fusion are not so high in their frequency of generation, such intrusion and agglomeration, however small in quantity they may occur at one time, accumulate in the developing device little by little during use of the device over a long period of time, and such accumulated effect appears on the developed image.

As measures against such unfavorable phenomena, there has heretofore been made a proposal, if any, to merely construct the developing device in a closed structure to prevent dust, etc. from entering into the device. In most cases, the toner within the developing device is totally taken outside the device, and the dust accumulated on the blade is removed every time the intrusion of the foreign substances and the fusion of the toner occur. Such method, however, not only takes time, but also causes considerable staining of the device, etc. due to scattering of the toner particles here and there, hence an improvement in this respect has been desired.

On the other hand, when the foreign substances accumulated on the edge of the magnetic blade are going to be removed by an external mechanical means without taking the developer out of the container vessel, there often takes place such a situation that the toner is often urged toward the surface of the developing sleeve which is the developer holding means with the consequence that the toner particles are agglomerated, or the toner mass is tightly adhered onto the sleeve surface to invite adverse effects.

(2) During a long period of developing operation, a thin layer of the developer is formed on the surface of the developer holding means to lower the developing capability.

At the time of the developing operation, the developer constantly repeats contact and separation to and from the surface of the developer holding means, on account of which the surface of the developer holding means tends to be stained with the developer, or a film layer of the developer tends to be formed. This thin layer of developer may be sometimes a resinous component of a low molecular weight contained in the developer, or in other cases, a controlling agent to impart the triboelectricity to the developer, or, in still other cases, very fine particles of the toner that have not contributed to the development. In any event, when these components cover the surface of the developer holding means, in particular, when the developing method which utilizes the charge of the developer, the charge quantity of the developer falls short to cause a lowering in the developing density, deterioration in the image reproducibility, and various other problems.

(3) During a long developing operation, the developer particles agglomerate to increase the adhesive force between the developer and the surface of the developer holding means, whereby formation of the developer layer in the uniform thickness becomes difficult, and irregularity in the image development takes place thereby.

No problem occurs so far as the developer coated on the developer holding means contributes to the development within a short period of time and then separates from the surface of the developer holding means. However, when the developer which has not contributed to the development due to low image density, and other reasons remains on the surface of the developer holding means for a long period of time, the developer particles increase their mutual agglomerating force to partially form a thicker coated layer on the surface, thereby causing irregularity in the developed image.

SUMMARY OF THE INVENTION

It is therefore an object of the present invention to provide an improved developing device which has entirely solved the problems inherent in the conventional developing devices as mentioned in the foregoing.

It is another object of the present invention to provide an improved developing device of good image reproducibility.

It is still another object of the present invention to provide an improved developing device capable of easily removing various foreign substances such as paper dust, thread dust, agglomerated toner particles, and others accumulated on the developer holding means.

It is yet another object of the present invention to provide an improved developing device capable of preventing a decrease in the development bias effect due to filming of the toner on the developer holding means, shortage in the charge quantity of the toner, and a decrease in the development density.

It is another object of the present invention to provide an improved developing device which does not cause irregularity in the developed image.

According to the present invention, generally speaking, there is provided a developing device for developing a latent image on a latent image holding member by application of a developing agent to the latent image, which comprises developer holding means disposed in confrontation to the latent image holding member, developer feeding means to feed the developer to the surface of the developer holding means, regulating means to regulate the thickness of a developer layer on the developer holding means, and shutter blade means which is so provided as to be able to take a contact position with the surface of the developing sleeve and a withdrawal position away from the sleeve surface.

The foregoing objects, other objects, the construction and operation of the developing device according to the present invention will become more apparent from the following detailed explanations thereof when read in conjunction with the accompanying drawing.

DETAILED DESCRIPTION OF PREFERRED EMBODIMENTS

Figure 1:
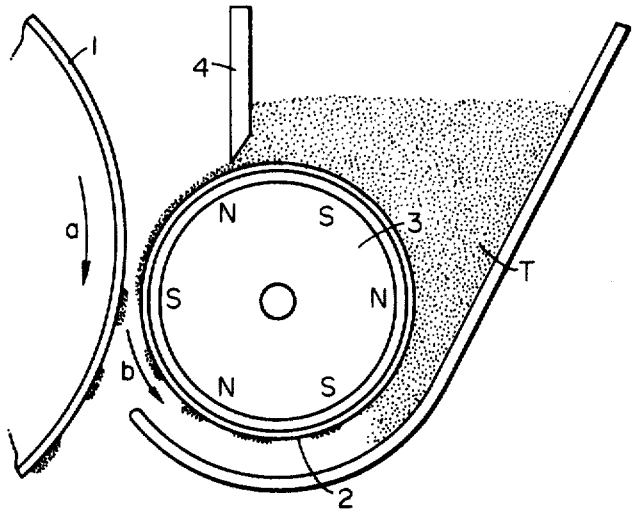
FIG. 1 (PRIOR ART)
FIG. 1 is a schematic cross-sectional view of a conventional developing device.

FIG. 1 shows the developing device, to which the present invention is applicable. In the drawing, a numeral 1 refers to an electrostatic latent image holding member consisting of a photosensitive member, an insulating member, etc., on which an electrostatic latent image has been formed. The latent image holding member moves in the direction of an arrow a. A numeral 2 refers to a developing sleeve of a non-magnetic material such as, for example, stainless steel, brass, etc.. The developing sleeve is disposed in confrontation to the latent image holding member with a small space gap (0.5 mm or so) therebetween and rotates in the direction of an arrow b. This small space gap is set wider than the thickness of the developer layer to be formed on the developing sleeve. Inside this developing sleeve, there is fixedly provided a magnetic roll 3 which is magnetized as illustrated. By the magnetic force of this magnetic roll 3, a layer of a developer T (having a mean particle diameter of approximately 30 microns) is formed on the surface of the developing sleeve 2. Thickness of the developer layer is regulated by a doctor blade 4 made of, for example, iron and disposed in contiguity to the surface of the developing sleeve. A space gap between the edge of the doctor blade 4 and the developing sleeve 2 is set at, for example, 0.3 mm. In order to perform thickness regulation of the developer layer accurately and securely, magnetic poles of approximately 600 gausses are disposed within the developing sleeve 2, whereby the developer layer is controlled to its thickness of approximately 70 microns. The thickness regulated developer layer then reaches a developing position facing the surface of the latent image holding member 1, thereby performing the image development in any of the developing methods as mentioned in the foregoing.

Here, if the developing operation is performed with the construction as shown in FIG. 1 as it is, the defects as listed in the above (1) to (3) would arise. The present invention is to remove these detects, according to which the construction of the developing device is improved as shown in FIGS. 2A to 2C.

Figure 2A:
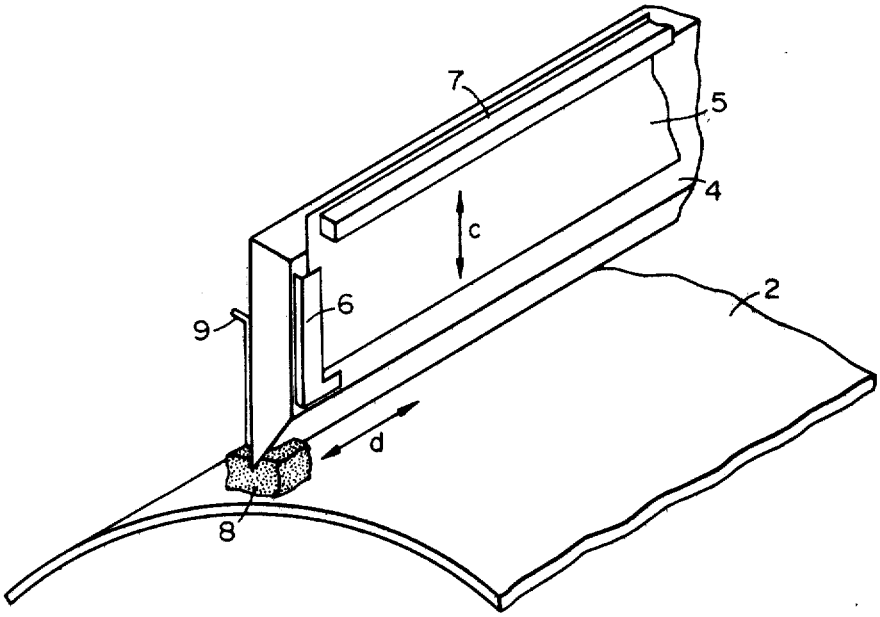
FIG. 2A is a perspective view of the main part of the developing device according to the present invention.
Figure 2B:
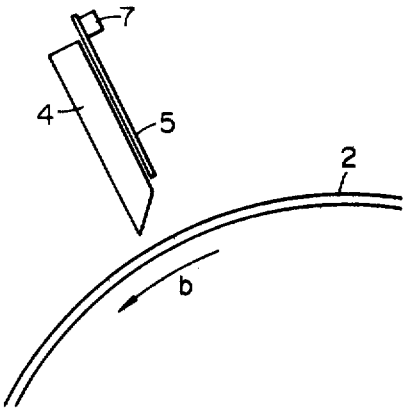
FIGS. 2B and 2C are respectively schematic side views of the device shown in FIG. 2A to show its operation.
Figure 2C:
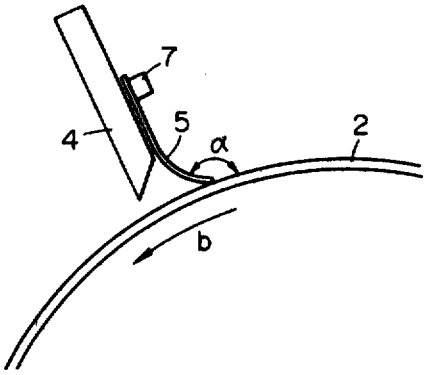

Explaining the present invention in reference to FIG. 2A, a numeral 4 refers to the doctor blade as also shown in FIG. 1. In this embodiment, the shutter blade 5 is provided at the side surface of the doctor blade, through which the developer is fed. This shutter blade 5 is so provided as to be movable in the arrow direction c along slide rails 6, 6. The shutter blade is maintained in its non-operative position in FIGS. 2A and 2B. In this non-operative state of the shutter blade 5, if and when foreign substances such as dusts, agglomerated toner particles, etc. intervene into the doctor blade 4 during the developing operation, or when carrying out periodical inspection of the device, the shutter blade 5 is brought into contact with the surface of the developing sleeve by means of a bar handle 7 provided on the top end part of the blade as shown in FIG. 2C, and by rotating the developing sleeve either manually or automatically, cleaning of the sleeve surface is carried out.

The shutter blade 5 as used here may be made of any kind of material. It has been found out experimentally that a relatively thin blade of metal material such as phosphor bronze of the thickness of 100 microns is effective. It has also been verified that a relatively thin sheet of rubber, plastic, and like other materials may be satisfactorily used for the purpose. An angle of contact of the shutter blade 5 to the developing sleeve should preferably be made such that an angle $\alpha$ at the developer feeding side constitutes an obtuse angle as shown in FIG. 2C, which is favorable from the aspects of the cleaning efficiency and prevention of the shutter blade from inverting its direction of contact.

Also, there is provided a cleaner pad 8 to remove the foreign substances agglomerated and adhered between the doctor blade 4 and the developing sleeve, 2, particularly on the edge of the doctor blade 4, even after removal of the foreign substances within the developing device by the shutter blade 5. The cleaner pad 8 is slidable breadthwise in the arrow direction d from end to end of the doctor blade 4 by a handle 9 provided thereon along its bottom edge, thereby removing the foreign substances remaining on the edge of the doctor blade. The pad 8 may always be positioned at one side end of the doctor blade and used by laterally sliding the same when necessity arises. The requirement which this cleaner pad 8 should satisfy is also not so stringent. As a rule, any material that does not damage the surface of the electrostatic image holding member, e.g., ordinary rubber material, etc., is sufficient to remove the foreign substances accumulated on the edge of the magnetic blade.

Figure 3A:
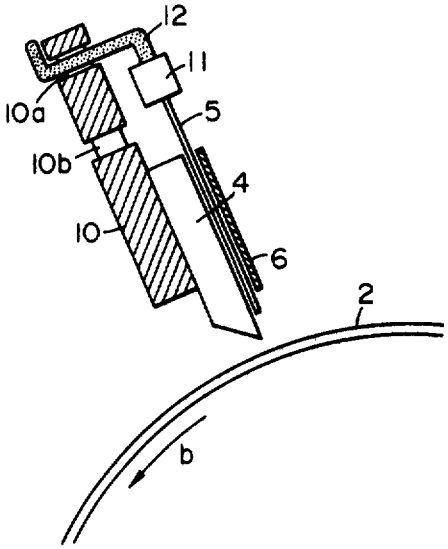
FIGS. 3A and 3B are partial cross-sectional views of another embodiment of the present invention to manually operate the shutter blade.
Figure 3B:
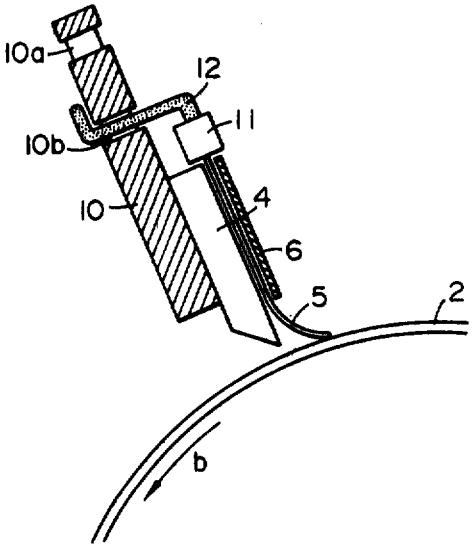

FIGS. 3A and 3B show partial cross-sections of another embodiment of the present invention, in which the shutter blade is manually brought into contact with and separated from the surface of the developing sleeve, the same as the embodiment shown in FIG. 2. FIG. 3A shows a case, wherein the shutter blade is separated from the surface of the photosensitive member, and FIG. 3B shows a case, wherein the blade is in contact with the photosensitive member. Incidentally, it is to be noted that those parts which are the same as those in the FIG. 2 embodiment are designated by the same reference numerals.

Two notches 10*a* and 10*b* for locking the shutter blade 5 are formed on either the doctor blade 4 or the supporting member 10 at both end parts thereof in the vertical direction. At both ends of the supporting member 11 for the shutter blade 5, there are provided rotatable levers 12. When the lever 12 is fitted into any of the notches 10*a* and 10*b*, the shutter blade can be fixed at its position. In the ordinary state, the lever 12 is engaged with the upper notch 10*a* as shown in FIG. 3A, whereby the shutter blade 5 is away from the surface of the developing sleeve 2. In case the foreign substances such as dusts, agglomerated toner, etc. are adhered between the doctor blade 4 and the sleeve 2, the lever 12 is moved down from the upper notch 10*a* to the lower notch 10*b* so that the shutter blade 5 may be locked in the state of its being in contact with the surface of the developing sleeve. In this state, when the sleeve 2 is rotated, only the foreign substances remain between the doctor blade 4 and the sleeve 2. These foreign substances are removed by the cleaning device such as cleaner pad 8, etc. as shown in FIG. 2. Fine particles of the toner which have been adhered onto the sleeve surface and formed a film layer can also be removed by this shutter blade 5.

Figure 4A:
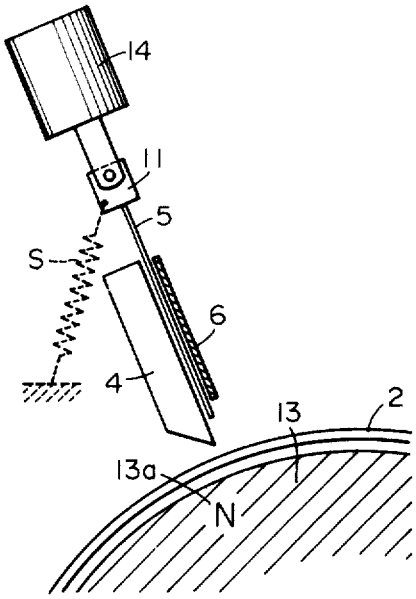
FIGS. 4A and 4B are also partial cross-sectional views of still another embodiment of the present invention to automatically operate the shutter blade.
Figure 4B:
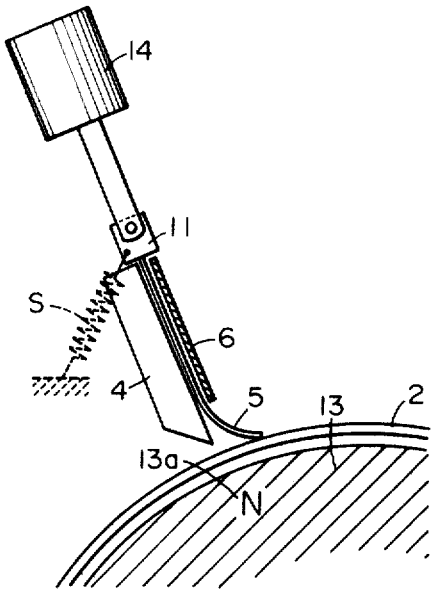

FIGS. 4A and 4B are also partial cross-sections of still another embodiment of the present invention. The device in this embodiment is so constructed that the shutter blade 5 may be automatically operated upon receipt of a signal from an image forming device such as an electrophotographic reproduction apparatus.

In this embodiment, the shutter blade 5 is made of a magnetic material such as iron, nickel, and others, or a magnet. Inside the sleeve 2, there is fixedly provided a magnet roller 13. A magnetic pole 13*a* is disposed at a position facing the magnetic blade 4 made of the magnetic material or magnet. The shutter blade 5 is constantly subjected to a force in the direction of its contact with the sleeve surface due to the magnetic force of attraction from the magnetic pole 13*a* (FIG. 4B). When a signal to open the shutter blade is imparted, a plunger 14 connected with the supporting member 11 of the shutter blade 5 is actuated, and the shutter blade 5 is pulled upward. In this case, a resin member may be fitted at the edge portion of the shutter blade, or a resinous coating may be applied thereon to prevent the sleeve from being damaged.

According to the experiments done by the present inventors, the shutter blade made an iron sheet of 50 to 150 microns thick and treated for rust prevention could be satisfactorily attracted to the surface of the developing sleeve upon application of the magnetic field of approximately 800 gausses from the magnetic pole 13*a*, whereby the cleaning of the toner could be done successfully. It is of course possible that, when the contact pressure is low, a spring is used together to increase the cleaning effect. Besides the magnetic material, sheets of rubber or plastic material as in the previous embodiment can also be used as the shutter blade for the purpose of the present embodiment. In this case, it is preferable to use a pressure member S (shown in dotted line in the drawing) such as spring, etc. for securing the contact of the shutter blade to the sleeve surface.

Figure 5A:
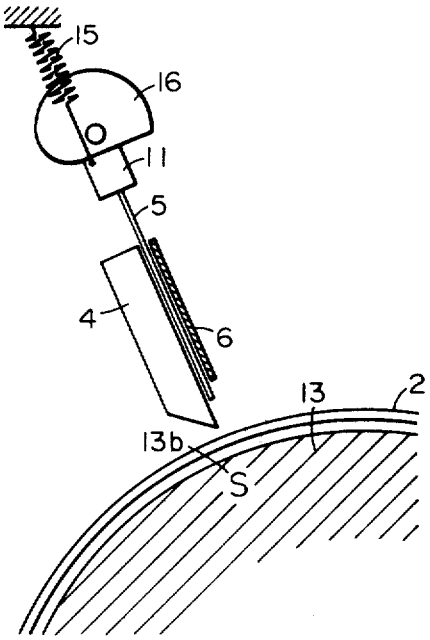
FIGS. 5A and 5B are partial cross-sectional views of yet another embodiment of the present invention.
Figure 5B:
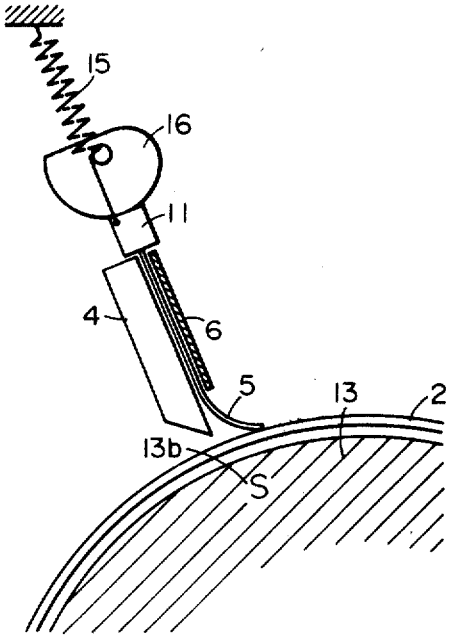

FIGS. 5A and 5B illustrate yet another embodiment of the present invention, wherein a spring 15 is hooked at one end of the supporting member 11 for the shutter blade 5, by which the blade 5 is drawn upward (FIG. 5A). When a signal to cause the shutter blade 5 to contact the sleeve 2 is imparted, a cam 16 is rotated a half turn by means of a motor of a plunger (not shown) to pull down the shutter blade 5 against force of the spring 15, thereby bringing the same into contact with the sleeve surface.

In this instance, the shutter blade 5 may be made of any appropriate material selected from a wide variety of materials such as metals, plastics, rubbers, and so forth. Also, the shutter blade can be contacted sufficiently vigorously to the sleeve surface by force of the cam, whereby stains adhered onto the sleeve surface, filming due to the resinous component contained in the toner, or adhesion of fine particles on the sleeve surface can be sufficiently cleaned.

Even in this embodiment, the shutter blade 5 can be closely contacted to the sleeve surface by use of the magnetic material or magnet for the blade, and by providing the magnetic pole 13*b* in the magnet roller 13 at a position opposite to the sleeve surface. The same thing can be said of the embodiments in FIGS. 2 and 3. Incidentally, the filming on the sleeve surface and irregularity in the toner coating can be prevented even when the shutter blade is disposed at a position other than the position of the doctor blade for regulating the toner layer thickness.

Figure 6:
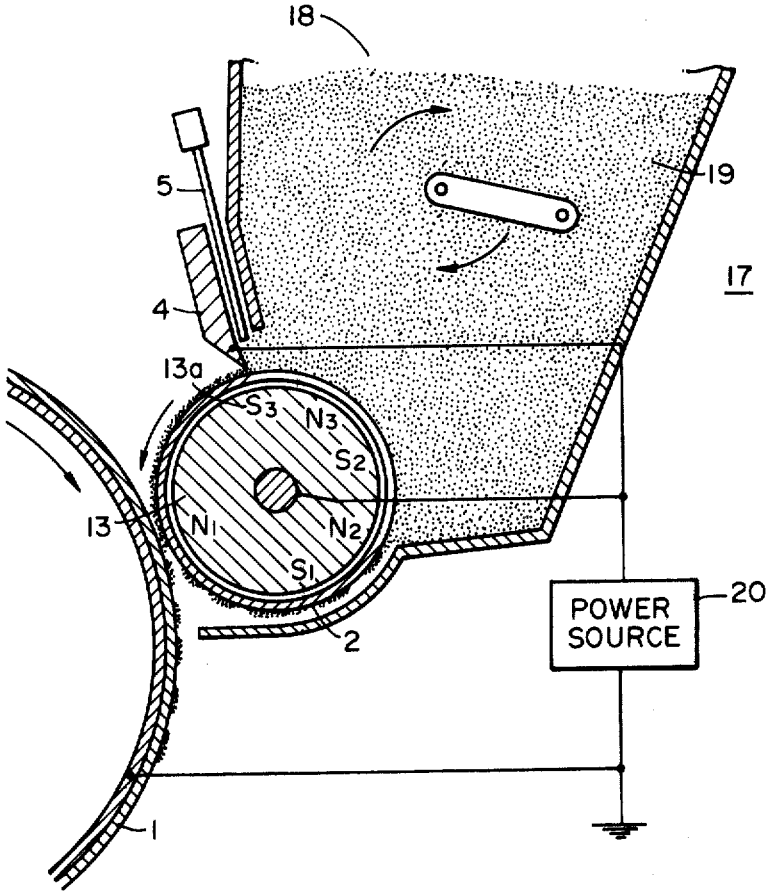
FIG. 6 is a schematic cross-sectional view of one embodiment of the developing device, to which the present invention is applied.

FIG. 6 shows one embodiment of the developing device, in which the present invention has been adopted. In this illustrated embodiment, the multi-polar permanent magnet 13 of the developing device (generally designated by a reference numeral 17) is fixed in position, and the sleeve 2 rotates in the arrow direction at the surface adjacent to the electrostatic image holding member 1. By the rotation of the developing sleeve 2, one component insulative ferromagnetic toner 19 fed from the toner container 18 is coated on the sleeve surface. In this instance, the charging system for the sleeve surface and the toner particles is so selected that, by friction between the sleeve surface and the toner particles, the toner particles may be charged in the opposite polarity as that of the electrostatic image charge. Furthermore, the doctor blade 4 made of iron material is disposed in contiguity to the sleeve surface (an interval of from 50 to 500 microns). The doctor blade 4 is in the form of a thin plate with the direction of the generatrix of the sleeve as its lengthwise direction. It is in the shape as shown in FIG. 2 for one example. By disposing this doctor blade at a position opposite to one magnetic pole 13*a* of the multi-polar permanent magnet 13 (the pole $S_3$ in the illustrated example), the thickness of the toner layer is regulated thinly and uniformly (in a range of from 30 to 300 microns, or preferably from 30 to 200 microns). A numeral 5 refers to the shutter blade according to the present invention, which performs cleaning of the surface of the sleeve or removal of dusts between the doctor blade 4 and the sleeve 2 by moving the same in the direction c. By adjusting the sleeve rotating speed, the surface layer speed of the toner layer, or preferably the inner speed of the toner layer may be made substantially equal to, or in the vicinity of, the speed of the surface of the electrostatic image holding member. In place of iron, other magnetic material may be used for the doctor blade 4, and an opposite magnetic pole may be formed. A magnet may also be used. A reference numeral 20 designates a power source to apply an alternating voltage across the non-magnetic cylinder 2 and the electrostatic image holding member 1. The blade 4 is maintained at the same potential as that of the toner holding member to prevent irregularity in the toner application.

For the magnetic toner used, there is such one, for example, consisting of 75 parts of polystyrene, 15 parts of magnetite, 3 parts of charge controlling agent, and 6 parts of carbon. These components are uniformly mixed by the well known method, and made into an average particle diameter of from 5 to 30 microns. Any other well known magnetic toner having the abovementioned particle size distribution and containing magnetic powder in the range of from 15 to 50 wt% may, of course, be used for the purpose of the present invention.

The reason for limiting the average particle size of the toner and the content of the magnetic powder in the abovementioned ranges is as follows. When the average particle diameter of the toner particles becomes smaller than 5 microns, the toner particles rigidly adhere onto the surface of the non-magnetic cylinder due to the electrostatic force to become difficult to be separated from the drum surface, whereby no satisfactory development cannot be effected. Further, there is formed on the surface of the non-magnetic drum a layer of fine toner particles to hinder the contact charging action between the newly fed toner particles and the drum surface, thereby causing lowering in the developing density due to insufficient toner transfer. On the other hand, when the average particle diameter of the toner particles becomes larger than 30 microns, the image as developed becomes disadvantageously coarse.

When the content of the magnetic powder becomes less than 15 wt%, there is obtained toner particles with less content of the magnetic powder as the result of pulverizing the toner components for producing the toner particles. And, when the toner particles containing a smaller amount of the magnetic powder are mixed in the developer, they tend to become easily agglomerated with the consequence that the resulting developer is inferior in its fluidity, and uniform charging of the toner particles becomes difficult, which causes fogging to occur readily. Also, the magnetic force of the toner particles to be attracted back to the magnet becomes lowered, which also causes fogging to occur, making it difficult to produce an image of good image quality. Further, the magnetic conveyance becomes difficult. On the other hand, when the content exceeds 50%, the resin component becomes less in quantity to deteriorate the image fixing property with the consequence that the quality of the resulting image becomes coarse and inferior for the practical use.

Figure 7:
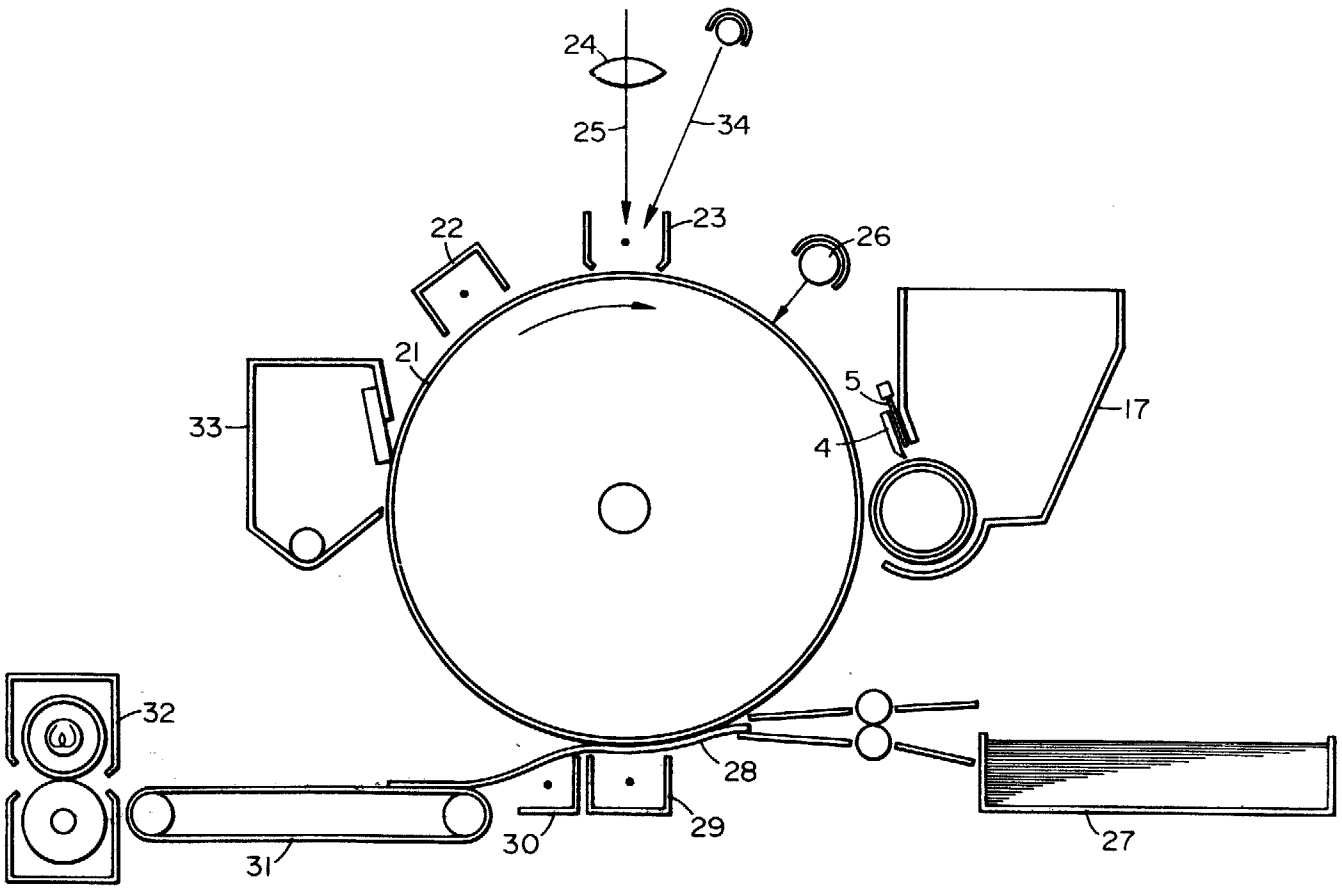
FIG. 7 is a schematic construction of an electrophotographic reproduction device, to which the developing device of the present invention is incorporated.

FIG. 7 illustrates one embodiment of an electrophotographic reproduction apparatus, in which the developing device of the present invention has been incorporated. In the drawing, the reproduction apparatus which adopts the process as described in U.S. Pat. No. 3,666,363, wherein the three-layered photosensitive member consisting of an electrically conductive substrate, a photoconductive layer formed on the substrate, and an insulating layer over the photoconductive layer is used, is schematically shown. In this embodiment, the photosensitive drum 21 made of the above-mentioned photosensitive member shaped in a drum form is rotated in the direction of an arrow mark by a driving means (not shown). The photosensitive drum 21 is subjected to a uniform corona discharge by the primary charger 22, and then to the corona discharge by means of a corona discharger 23 in the secondary a.c. or in the polarity opposite to the of the primary charger 22. Simultaneously, the photosensitive drum is subjected to the image exposure through an optical system 24, and then to a uniform exposure over the entire surface of the photosensitive drum 21 by an overall exposure lamp 26. In this manner, an electrostatic latent image of high image contrast is obtained on the surface of the photosensitive drum 21. The thus obtained electrostatic latent image is developed by a developer 17, and this developed image is transferred by a transfer charger 29 onto an image transfer paper 28 fed from a paper feeding cassette 27. The image transfer paper 28, onto which the image has been transferred, is then separated from the photosenitive drum 21 by a paper separation charger 30, and conveyed by a conveyor belt 31. Thereafter, the developed image transferred onto the image transfer paper 28 is fixed thereon by an image fixing device 32. On the other hand, the surface of the photosensitive drum 21 is wiped by a cleaning device 33 to remove residual toner thereon. It is to be noted incidentally that, in the illustrated embodiment, the light 34 to be irradiated onto the photosensitive drum 21 simultaneously with the image exposure 25 is a blank exposure light which is imparted to the drum simultaneously with the secondary corona discharge for preventing unnecessary amount of the developer from adhering onto the photosensitive drum.

Figure 8:
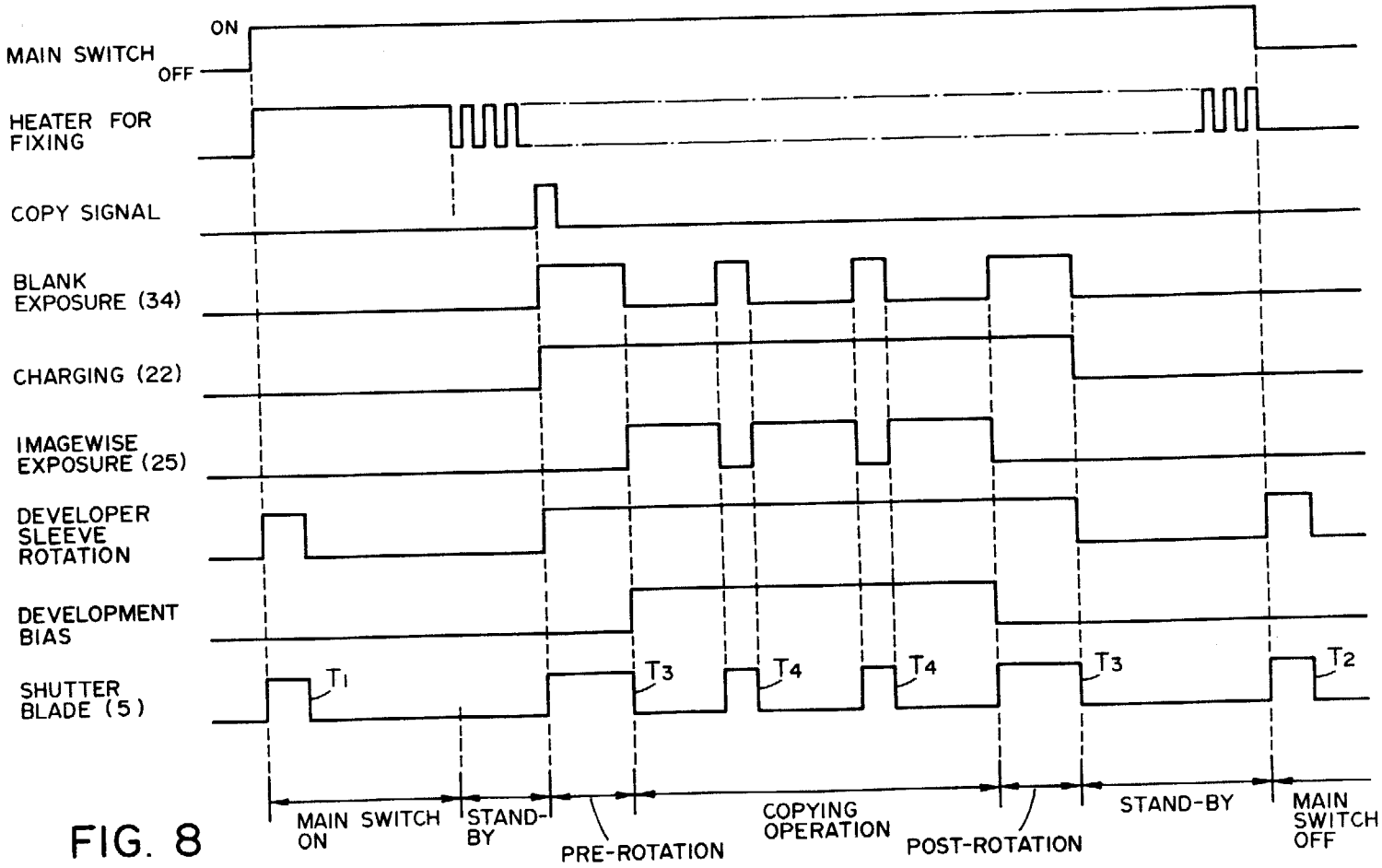
FIG. 8 is a timing chart to operate the shutter blade in the reproduction device shown in FIG. 7.

FIG. 8 shows an example of the timing chart to operate the shutter blade in the electrophotographic reproduction apparatus shown in FIG. 7. The shutter blade should be operated, as a rule, when no image reproduction is being conducted, because, while the shutter blade is in contact with the surface of the developing sleeve, no toner can be fed to the sleeve.

The first embodiment is to actuate the shutter blade in synchronism with "on" and "off" of the main switch in the reproduction apparatus. As soon as the main switch is "on", the developing sleeve is rotated and the shutter blade is caused to contact onto the sleeve surface ($T_1$). In the same manner, the sleeve is also rotated when the main switch is "off" to actuate the shutter blade ($T_2$). In practice, the solenoid or the cam as shown in FIGS. 4 or 5 is actuated upon receipt of the signals $T_1$, $T_2$. It is preferable that the shutter blade be maintained in contact with the surface of the developing sleeve while the sleeve is performing at least one rotation.

After the reproduction apparatus has been in an inoperative state for a long period of time, when the shutter blade is actuated in synchronism with the main switch closure, if functions to remove from the sleeve surface the toner particles which are prone to be agglomerated on the sleeve due to their moisture absorption, etc. as the result of their having remained on the sleeve surface for a long time, whereby uniform toner coating can be done. When the shutter blade is operated after completion of the copying operation (i.e., after opening of the main switch), it serves to remove the toner on the sleeve surface, whereby its scattering outside the apparatus and its moisture absorption can be prevented. Since the shutter blade has less opportunity to contact the sleeve, no remarkable damage is caused the blade, hence selection of the material for the blade is easy.

The second embodiment is as follows. Prior to entering into the actual copying operation, or after completion of the copying operation, it sometimes occurs that the electrophotographic reproduction apparatus does not perform the image original exposure alone, but operates all the other constituent devices. Usually, the former is called "pre-rotation", and the latter "post-rotation". In synchronism with these pre- and post-rotations, the shutter blade is actuated ($T_3$). Immediately before starting or after completion of the copying operation, the surface of the developing sleeve is cleaned to secure a predetermined toner coating. At the time of both pre- and post-rotations, the surface of the photosensitive member has been subjected to the charging and exposure, hence adhesion of the toner onto the drum surface is usually observed to some extent. However, by closing the shutter blade, the toner adhesion can be prevented.

The third embodiment is concerned with a method of operating the shutter blade during the copying operation. No image formation is effected during a period from an image original exposure to the subsequent image original exposure. On account of this, light is irradiated onto the photosensitive drum from the blank exposure lamp 34 to remove the charge on the drum. During this non-forming period ($T_4$), the shutter blade is closed to clean the sleeve surface. In this way, the sleeve surface can always be maintained in its cleaned state. Also, since the shutter blade is closed, except for the developing process step, scattering of the toner from the developing device can be kept to the minimum possible extent.

The developing device according to the present invention can be utilized in other types of the reproduction apparatuses than that as mentioned above, wherein the three-layered photosensitive member is used, such as the reproduction apparatus based on the Carlson process using a double-layered photosensitive member, or in an electronic photo-printer using a laser beam, a magnetic printer using a magnetic latent image, and others.

As described in the foregoing, since the present invention provides the shutter blade in the developing device so that it may take a contact position with the surface of the developer holding means, and a withdrawal position away from the surface, cleaning of dust, agglomerated toner particles, and so on accumulated between the developer layer thickness regulating means and the developer holding means becomes easy. Also, undesirable filming phenomenon of the toner on the surface of the developer holding means can be prevented, which contributes to prevention of the lowering in the developing bias effect, shortage in the frictional charging quantity of the toner, lowering in the developing density, irregularity in the developed image, deterioration in the image reproducibility, etc. Furthermore, since the surface of the developer holding means can be constantly kept clean, the uniform coating of the toner on the surface is secured.

What is claimed is:

1. A developing device for developing a latent image held on a latent image holding member by application of a developing agent to said latent image, which comprises:

(a) developer holding means disposed in confrontation with the latent image holding member;

(b) developer feeding means to feed the developer to the surface of said developer holding means;

(c) regulating means to regulate the thickness of a developer layer on said developer holding means;

(d) shutter blade means of magnetic material or a magnet positioned and arranged for movement between a contact position where said shutter blade means contacts the surface of said developer holding means and a withdrawn position away from the surface of said developer holding means; and (e) a fixed magnetic field generating means provided at a position opposite to said magnetic shutter blade means with a portion of the developer holding surface interposed therebetween, wherein said magnetic field generating means attracts said shutter blade means to said portion of the developer holding surface.

2. A developing device for developing a latent image held on a latent image holding member by application of a one-component developing agent to said latent image, which comprises:

(a) developer holding means disposed in confrontation with the latent image holding member;

(b) developer feeding means to feed the developer to the surface of said developer holding means;

(c) magnetic regulating means of magnetic material or a magnet to regulate the thickness of a developer layer on said developer holding means;

(d) a fixed magnetic pole provided at a position opposite to said magnetic regulating means with a portion of the developer holding surface interposed therebetween; and (e) shutter blade means, formed of a magnetic material or a magnet, which is positioned and arranged for movement between a contact position where said shutter blade means contacts the surface of said developer holding means and a withdrawn position away from the surface of said developer holding means, wherein said shutter blade means is slidably disposed on the upstream side of said regulating means with respect to the direction of developer feed.

3. The developing device as set forth in claim 1 or 2, wherein the contact angle of said shutter blade means with respect to the surface of said developer holding means is obtuse at the side from which developer is fed.

4. The developing device as set forth in claim 1 or 2, further comprising a cleaning device to remove foreign substances existing between said developer layer thickness regulating means and said developer holding means.

5. The developing device as set forth in claim 1 or 2, further comprising locking means to fix said shutter blade means at the contact position and the withdrawn position.

6. The developing device as set forth in claim 5, further comprising a supporting member for said shutter blade means and a supporting member for said thickness regulating means, and wherein said locking means comprises a lever provided on one part of said supporting member for said shutter blade means and a notch, in which said lever may be engaged, formed in said developer layer thickness regulating means or said supporting member therefor.

7. The developing device as set forth in claim 2, wherein a magnetic pole is provided at a position opposite to said magnetic shutter blade means with said developer holding means being interposed therebetween.

8. The developing device as set forth in claim 1 or 2, wherein said device is associated with an image forming device and further comprising means for automatically actuating said shutter blade in response to a signal from said image forming device.

9. The developing device as set forth in claim 8, wherein said image forming device is actuated by a main switch and wherein said shutter blade means is automatically actuated in synchronism with the "on" and "off" conditions of the main switch in said image forming device.

10. The developing device as set forth in claim 8, wherein said image forming device is rotatable and wherein said shutter blade means is automatically actuated at the time of prerotational operation of said image forming device.

11. The developing device as set forth in claim 8, wherein said image forming device is rotatable and wherein said shutter blade means is automatically actuated at the time of post-rotational operation of said image forming device.

12. The developing device as set forth in claim 8, wherein said shutter blade means is automatically actuated when no image forming operation is being conducted by said image forming means.

13. The developing device as set forth in claim 1, wherein said developer layer thickness regulating means is a magnetic blade made of a magnetic material or a magnet.

14. The developing device as set forth in claim 13, wherein said magnetic field generating means has a magnetic pole at a position confronting said regulating magnetic blade.

15. The developing device as set forth in claim 1, or 2 wherein thickness of the developer layer is regulated by said developer layer thickness regulating means to a thickness smaller than a space gap between said latent image holding member and said developer holding means, and a small space gap is formed between the surfaces of said latent image holding member and said developer layer.

16. The developing device as set forth in claim 15, wherein said developer is insulative.

17. The developing device as set forth in claim 15, wherein an alternating electric field is applied across said small space gap.

18. The developing device as set forth in claim 17, wherein said developer layer thickness regulating means is maintained at the same electric potential as that of said developer holding means.

19. The developing device as set forth in claim 15, wherein the space gap between the developer holding means and the latent image holding member ranges from 100 to 500 microns.

20. The developing device as set forth in claim 15, wherein the thickness of the developer layer ranges from 30 to 300 microns.

21. A developing device for developing a latent image on a latent image holding member by application of a developer to the latent image, comprising:

(a) a single component magnetic toner;

(b) a container for accomodating therein said toner;

(c) a sleeve as a developer holding means which is rotatably held on said toner container;

(d) a magnet roller as a magnetic field generating means which is fixedly provided in said sleeve;

(e) a magnetic blade of magnetic material or a magnet as a thickness relating member, said blade being disposed in contiguity with said sleeve and which regulates the thickness of the toner on the surface of said sleeve; and (f) a shutter blade, formed of a magnetic material or a magnet, which is positioned and arranged for movement between a contact position with respect to said sleeve surface and a withdrawn position away from said sleeve surface, said shutter blade means being slidably disposed on the upstream side of said magnetic blade with respect to the direction of developer feed.

* * * * *